US011338162B2

(12) United States Patent
Siem

(10) Patent No.: US 11,338,162 B2
(45) Date of Patent: May 24, 2022

(54) LOW MOLECULAR WEIGHT POLYETHYLENE GLYCOL (PEG) IN FLUORINE CONTAINING FIRE FIGHTING FOAM CONCENTRATES

(71) Applicant: Tyco Fire Products LP, Lansdale, PA (US)

(72) Inventor: Mark Adam-Christopher Siem, Menominee, MI (US)

(73) Assignee: Tyco Fire Products LP, Lansdale, PA (US)

( * ) Notice: Subject to any disclaimer, the term of this patent is extended or adjusted under 35 U.S.C. 154(b) by 210 days.

(21) Appl. No.: 16/004,010

(22) Filed: Jun. 8, 2018

(65) Prior Publication Data

US 2018/0361185 A1 Dec. 20, 2018

Related U.S. Application Data

(63) Continuation of application No. 14/776,395, filed as application No. PCT/US2014/029743 on Mar. 14, 2014, now abandoned.

(60) Provisional application No. 61/789,604, filed on Mar. 15, 2013.

(51) Int. Cl.
*A62D 1/02* (2006.01)

(52) U.S. Cl.
CPC ..... *A62D 1/0071* (2013.01); *A62D 1/0085* (2013.01)

(58) Field of Classification Search
CPC ..... A62D 1/071; A62D 1/0085
See application file for complete search history.

(56) References Cited

U.S. PATENT DOCUMENTS

| | | | | |
|---|---|---|---|---|
| 3,957,657 | A | 5/1976 | Chiesa, Jr. | |
| 4,060,132 | A | 11/1977 | Chiesa, Jr. | |
| 4,060,489 | A | 11/1977 | Chiesa, Jr. | |
| 4,306,979 | A | 12/1981 | Tsuji | |
| 4,387,032 | A | 6/1983 | Chiesa, Jr. | |
| 4,420,434 | A | 12/1983 | Falk | |
| 4,424,133 | A | 1/1984 | Mulligan | |
| 4,464,267 | A | 8/1984 | Chiesa et al. | |
| 5,207,932 | A | 5/1993 | Norman et al. | |
| 5,218,021 | A | 6/1993 | Clark et al. | |
| 5,750,043 | A | 5/1998 | Clark | |
| 6,156,222 | A | 12/2000 | Jennings et al. | |
| 6,262,128 | B1 | 7/2001 | Stern et al. | |
| 6,528,544 | B2 | 3/2003 | Stern et al. | |
| 8,298,436 | B2 | 10/2012 | Michael | |
| 8,524,104 | B1 | 9/2013 | Michael | |
| 9,289,636 | B2 | 3/2016 | Mathis | |
| 9,669,246 | B2 | 6/2017 | Bowen et al. | |
| 9,956,447 | B2 | 5/2018 | Martin et al. | |
| 9,956,448 | B2 | 5/2018 | Martin | |
| 10,004,191 | B2 | 6/2018 | Vreugdenhil | |
| 2001/0027218 | A1* | 10/2001 | Stern | A62D 1/0071 516/10 |
| 2012/0118590 | A1 | 5/2012 | Mathis | |
| 2013/0277597 | A1 | 10/2013 | Bowen et al. | |
| 2016/0023032 | A1 | 1/2016 | Bowen | |
| 2016/0030793 | A1 | 2/2016 | Xie | |
| 2016/0038778 | A1 | 2/2016 | Siem | |
| 2016/0038779 | A1 | 2/2016 | Bowen et al. | |
| 2017/0182341 | A1 | 6/2017 | Libal | |

FOREIGN PATENT DOCUMENTS

| | | | |
|---|---|---|---|
| CN | 1539532 | A * | 10/2004 |
| WO | WO-00/35536 | A1 | 6/2000 |
| WO | WO-2012/045080 | A1 | 4/2012 |

OTHER PUBLICATIONS

English machine translation of Yu et al. CN1539532A (Year: 2004).*

"Dow Answer Center", Carbowax PEG polydispersity index, Oct. 11, 2016, https://dowac.custhelp.com/app/answers/detail/a_id/6350/kw/carbowax%20polydispersity.

International Search Report and Written Opinion for International Application No. PCT/US2014/029743, dated Jul. 7, 2014.

* cited by examiner

*Primary Examiner* — Peter F Godenschwager
(74) *Attorney, Agent, or Firm* — Foley & Lardner LLP

(57) ABSTRACT

It has been discovered that low molecular weight poly (ethyleneglycol) (PEG) can be used in place of diethylene glycol monobutyl ether (DGME) in fire foam concentrates without compromising the desirable properties provided by DGME. Surprisingly it has been found that lower molecular weight PEG with a weight average molecular weight Mw of 400 or less provides comparable performance to DGME with considerably lower toxicity. Use of this PEG permits preparation of fire foam concentrates that exclude DGME completely and that are less toxic than conventional DGME-containing concentrates.

26 Claims, No Drawings

LOW MOLECULAR WEIGHT POLYETHYLENE GLYCOL (PEG) IN FLUORINE CONTAINING FIRE FIGHTING FOAM CONCENTRATES

PRIORITY DATA

This application is a continuation of U.S. application Ser. No. 14/776,395, filed on Sep. 14, 2015, which is a U.S. National Stage Application of International Application No. PCT/US2014/029743, filed Mar. 14, 2014, which claims the benefit of U.S. Provisional Patent Application No. 61/789,604, filed Mar. 15, 2013. Each of the aforementioned applications are incorporated herein by reference in their entireties.

BACKGROUND

Conventional firefighting foam concentrates containing fluorinated surfactants routinely contain diethylene glycol monobutyl ether (DGME or Butyl Carbitol) as a foam stabilizing solvent and wetting agent. This solvent also provides concentrate stability and firefighting solution stability. Despite these advantages, DGME poses a problem in that it is considered to be relatively toxic, with a dermal LD50 in rabbits of only 2.7 g/kg. It is also toxic to fish and other aquatic wildlife, which creates an issue with runoff when a fire fighting foam is used.

SUMMARY

An aqueous firefighting foam concentrate is provided containing at least one fluorinated surfactant and poly(ethyleneglycol) having a weight average molecular weight of about 400 or less, where the concentrate is free of diethylene glycol monobutyl ether. Advantageously, the poly(ethyleneglycol) has a weight average molecular weight of about 200.

The concentrate may also contain at least one, at least two, or at least three non-fluorinated hydrocarbon surfactants. In some embodiments they may contain one or more components selected from the group consisting of at least one or at least two polysaccharide gums, a fluoropolymer, a biocide, a corrosion inhibitor and an electrolyte, where the concentrate is free of DGME.

In a certain embodiment there is provided an aqueous firefighting foam concentrate containing at least one fluorinated surfactant, a poly(ethyleneglycol) having a weight average molecular weight of about 200, at least two non-fluorinated surfactants selected from the group consisting of anionic, zwitterionic and nonionic surfactants, a fluoropolymer, a corrosion inhibitor, and an electrolyte, where the concentrate is free of DGME.

In another embodiment there is provided an alcohol-resistant aqueous firefighting foam concentrate containing at least one fluorinated surfactant, poly(ethyleneglycol) having a weight average molecular weight of about 200, at least one non-fluorinated surfactant selected from the group consisting of anionic, zwitterionic and nonionic surfactants, a fluoropolymer, a corrosion inhibitor, an electrolyte, a polysaccharide gum, and a biocide, where the concentrate is free of DGME.

Also provided are firefighting foams prepared by foaming a concentrate as described above, together with methods of making a firefighting foam by foaming a concentrate as described above with water or an aqueous liquid.

Methods of extinguishing a fire are provided by foaming a concentrate as described above and applying the resulting foam to the fire. The fire may be fueled by, for example, hydrocarbon fuels, or polar solvents, or may be a Class A material.

DETAILED DESCRIPTION

It has been discovered that low molecular weight poly(ethyleneglycol) ("PEG") can be used in place of DGME in fire foam concentrates without compromising the desirable properties provided by DGME. Previous attempts to replace DGME with poly(ethyleneglycol) of higher molecular weight have been unsuccessful but, surprisingly, it has been found that lower molecular weight PEG with a weight average molecular weight $M_w$ of 400 or less provides comparable performance to DGME with considerably lower toxicity. Advantageously, the PEG has an $M_w$ of about 200. In the present context, the use of this PEG permits preparation of fire foam concentrates that exclude DGME completely and that are less toxic than conventional DGME-containing concentrates.

The table below compares the toxicity of DGME and PEG with an $M_w$ of about 200 (PEG200 in the table), demonstrating the significantly lower toxicity associated with the PEG.

| | DGME | PEG (200) |
|---|---|---|
| LD50 Oral - rat | 5,660 mg/kg | 30,200 mg/kg |
| LD50 Dermal - rabbit | 2,700 mg/kg | >20,000 mg/kg |
| Toxicity to fish LC50 | 1,300 mg/l<br>*Lepomis macrochirus* | >100 mg/l<br>Emerald Shiner (*Notropis atherinoides*) |
| | >1,000 mg/l<br>*Leuciscus idus* (Golden orfe) | >10,000 mg/l<br>Fathead Minnow (*Pimephales promelas*) |
| Toxicity to daphnia and other aquatic invertebrates LC50 - *Daphnia magna* (Water flea) | 1,950 mg/l | >10,000 mg/l |
| Toxicity to algae IC50 - *Desmodesmus subspicatus* (green algae) | >100 mg/l-24 h | N/A |
| Toxicity to bacteria LC50 - *Pseudomonas putida* | 1,170 mg/l-16 h | N/A |
| Theoretical oxygen demand | 2.17 mg/mg (calculated) | 1.67 mg/mg (calculated) |

The low molecular weight PEG can be present in amounts of between 1 and about 20%. One skilled in the art will recognize that the PEG can readily be added to concentrates in incremental amounts and the effect on the concentrate properties readily determined using methods well known in the art. In this fashion the PEG can be used in an amount that provides the desired properties for the concentrate. Thus, for example, DGME can be used in amounts of 1-5%, up to 10%, 15%, and up to 20%.

The PEG can be used to replace DGME in essentially any firefighting foam concentrate, including AFFF and AR-AFFF foams. The components of such foams are described below.

Fluorocarbon Surfactants

Fluorochemical surfactants are typically single perfluoro-tail molecules and may have multiple hydrophilic heads. Advantageously, the fluorochemical surfactant contains perfluoroalkyl groups no longer than $C_6$, although Cg and longer fluorosurfactants can also be used. Examples of suitable fluorochemical surfactants include those described in WO/2012/045080. The quantity of fluorochemical surfactant(s) may be added to increase extinguishing speed and burnback resistance. Fluorosurfactants suitable for use in firefighting foams are well known in the art and are commercially available from, for example, Chemguard (Midland, Tex.) and Dynax (Pound Ridge, N.Y.)

Fluoropolymer Component

High molecular weight fluoropolymers are typically used in AR-AFFF foams to allow a reduction in the amount of polysaccharide gum present in the concentrate and to lower the viscosity. See, for example, U.S. Pat. No. 6,156,222. Therefore, a significant portion of the gum can be replaced by fluoropolymer stabilizers to give better AR-AFFF performance.

Hydrocarbon Surfactants

The concentrates may include one or more hydrocarbon (non-perfluoroalkyl containing) surfactant, present in an amount suitable to provide the desired foaming characteristics of the concentrate. The surfactant can be fluorinated or non-fluorinated and can be an anionic surfactant, a zwitterionic surfactant or a nonionic surfactant. Combinations of surfactants can be used, including multiple anionic surfactants, zwitterionic surfactants and nonionic surfactants. Advantageously, the concentrate contains at least one anionic surfactant, at least one zwitterionic surfactant and at least one nonionic surfactant. Exemplary surfactants are octyl sulphate (anionic), lauryl diproprionate (zwitterionic), and an alkyl polyglycoside (non-ionic). The alkyl polyglycoside can be, for example, a $C_8$-$C_{10}$ alkyl polyglycoside with a 1.6 degree of polymerization. The surfactant or surfactants are used in concentrations of 1-25% (total surfactant wt %). A typical surfactant combination is 1-10 wt % anionic surfactant, 5-20 wt % alkylpolyglycoside, and 5-25 wt % zwitterionic surfactant. An exemplary combination is 5-8 wt % octyl sulfate, 10-25 wt % lauryl dipropionate and 6-11 wt % $C_8$-$C_{10}$ alkyl polyglycoside with a 1.6 degree of polymerization.

Suitable surfactants, especially anionic and non-ionic surfactants, are well known to those skilled in the art and can be purchased commercially. Suitable anionic surfactants are especially $C_8$-$C_{20}$-alkyl sulfates, i.e. sulfuric monoesters of $C_8$-$C_{20}$-alkanols, e.g. octyl sulfate, 2-ethylhexyl sulfate, decyl sulfate, lauryl sulfate, myristyl sulfate, cetyl sulfate and stearyl sulfate, and salts thereof, especially the ammonium, substituted ammonium and alkali metal salts thereof, and also Cg-$C_{20}$-alkyl ether sulfates, i.e. sulfuric monoesters of C2-$C_4$-alkoxylated $C_8$-$C_{20}$-alkanols, especially sulfuric monoesters of ethoxylated $C_8$-$C_{20}$-alkanols and salts thereof, especially the ammonium, substituted ammonium and alkali metal salts thereof, where the degree of alkoxylation (or degree of ethoxylation), i.e. the number of $C_2$-$C_4$-alkylene oxide repeat units (or ethylene oxide repeat units) is generally in the range from 1 to 100 and especially in the range from 2 to 20. Examples of $C_8$-$C_{20}$-alkyl ether sulfates are the sulfuric monoesters of ethoxylated n-octanol, of ethoxylated 2-ethylhexanol, of ethoxylated decanol, of ethoxylated lauryl alcohol, of ethoxylated myristyl alcohol, of ethoxylated cetyl alcohol and of ethoxylated stearyl alcohol. The concentrate preferably comprises a mixture of at least 2, for example 2 or 3, anionic surfactants with different carbon numbers.

Suitable anionic surfactants are especially surfactants based on the sodium salt of octyl sulfate and triethanolammonium salts of fatty alcohol sulfates, preferably a mixture of lauryl sulfate and myristyl sulfate, components which are commercially available under the names Texapon 842 and Hansanol AS 240T. Further suitable commercially available products are Sulfethal 40/69 and Sabosol C8.

Examples of non-ionic surfactants are alkyl polyglucosides, especially alkyl polyglucosides having 6 to 14 carbon atoms in the alkyl radical, for example the commercial product Glucopon 215 UP from Cognis, or the $C_9$/$C_{11}$Cci/Cn-alkyl polyglucoside sold under the trade name APG325n from Cognis. The chemical nature of these surfactants for use in accordance with the invention is not critical, but preference is given to using materials which are based on renewable raw materials and/or are biodegradable.

Zwitterionic (amphoteric) surfactants have both cationic and anionic centers attached to the same molecule. The cationic moiety typically is an ammonium group, including primary, secondary, or tertiary amines or quaternary ammonium cations. The anionic moiety can be, for example, sulfates, sulfonates, sultaines and phosphates. Zwitterionic detergents are well known in the art and include sodium N-lauryl-P-iminodipropionate, commonly referred to as lauryl dipropionate. Zwitterionic surfactants also include, but are not limited to, those which contain in the same molecule, amino and carboxy, sulfonic, and sulfuric ester moieties and the like. Higher alkyl ($C_6$-$C_{14}$) betaines and sulfobetaines are included in this category. Commercially available products include Chembetaine CAS (Lubrizol Inc.) and Mirataine CS (Rhodia), both sulfobetaines, and Deriphat 160C (BASF), a $C_{12}$ amino-dicarboxylate.

Where fluorosurfactants are used, the surfactants are typically single perfluoro-tail molecules and may have multiple hydrophilic heads. Advantageously, the fluorochemical surfactant contains perfluoroalkyl groups no longer than $C_6$, although Cg and longer fluorosurfactants can also be used. Examples of suitable fluorochemical surfactants include those described in WO 2012/045080.

Sequestering, Buffer, and Corrosion Package

The components of the sequestering, buffer, and corrosion package, include agents that sequester and chelate metal ions. Examples include polyaminopolycarboxylic acids, ethylenediaminetetraacetic acid, citric acid, tartaric acid, nitrilotriacetic acid, hydroxyethylethylenediaminetriacetic acid and salts thereof. Buffers are exemplified by Sorensen's phosphate or McIlvaine's citrate buffers. The nature of the corrosion inhibitors is limited only by compatibility with other formula components. Typical corrosion inhibitors include ortho-phenylphenol, tolyltriazole, and many phosphate ester acids.

Polymeric Film Former

These water-soluble polymeric film formers, partially or fully hydrated in AR-AFFF agents, precipitate from solution when the bubbles contact polar solvent fuels, and form a vapor-repelling polymer film at the solvent/foam interface, preventing further foam collapse. Examples of suitable compounds include thixotropic polysaccharide gums as described in U.S. Pat. Nos. 3,957,657; 4,060,132; 4,060,489; 4,306,979; 4,387,032; 4,420,434; 4,424,133; 4,464,267, 5,218,021, and 5,750,043, which are herein incorporated by reference. Suitable commercially available compounds are marketed as Rhodopol, Kelco, Keltrol, Actigum, Cecal-gum, Galaxy, and Kelzan.

Surprisingly, it also has been found that use of gum combinations allows for use of lower amounts of gum without compromising performance, thereby also lowering the viscosity of the concentrates. Specifically, it has been found that a combination of a galactomannan gum, such as guar gum, and a xanthan gum is highly effective in lowering the amount of gum necessary to provide suitable performance. Alternatively, use of gum combinations allows use of higher amounts of gum without raising viscosity to an unacceptable or unusable level. Roughly equal amounts of each gum can be used, but the person of ordinary skill will recognize that the relative proportions of the gums can be varied to vary the properties of the concentrates.

The gum or gum mixture is present typically in an amount of 0.2 to 7% by weight (total gum), advantageously 1 to 6% by weight or 2 to 5% by weight. In some concentrates, a combination of 2% galactomannan gum (such as guar gum) and 2% xanthan gum, has been found to be effective.

Gums that can be used include modified celluloses and modified starches, especially cellulose ethers such as methylcellulose, carboxymethylcellulose, hydroxyethylcellulose, hydroxypropylcellulose, methylhydroxypropylcellulose, methylhydroxyethyl-cellulose, natural polysaccharides such as xanthan, carrageenan, especially κ-carrageenan, λ-carrageenan or τ-carrageenan, alginates, guaran and agar, and also modified xanthan such as succinylglycan, or modified carrageenan. Xanthan and modified xanthan gums are commercially available under the trade names Keltrol® and Kelzan® from Kelco, for example the Keltrol® products Keltrol® CG, Keltrol® CG-F, Keltrol® CG-T, Keltrol® CG-BT, Keltrol® CG-SFT or Keltrol® RT, and the Kelzan® products Kelzan® T, Kelzan® ST, Kelzan® HP-T and Kelzan® ASX-T and Rhodopol®, e.g. the Rhodopol® products 23, 50MC, G, T and TG from Rhodia. Xanthan-based thickeners also are commercially available under the Keltrol® name.

Antimicrobials and Preservatives

These components may be used to prevent biological decomposition of natural product based polymers incorporated as polymeric film formers. Examples include Kathon CG/ICP (Rohm & Haas Company) and Givgard G-4 40 (Givaudan, Inc.), and are disclosed in U.S. Pat. No. 5,207,932, which is herein incorporated by reference. Additional preservatives are disclosed in U.S. Pat. Nos. 3,957,657; 4,060,132; 4,060,489; 4,306,979; 4,387,032; 4,420,434; 4,424,133; 4,464,267, 5,218,021, and 5,750,043.

Electrolytes

Electrolytes may be added to AFFF and AR-AFFF agents in small amounts to balance the performance of such agents when proportioned with water ranging from soft to very hard, including sea water or brine, and to improve agent performance in very soft water. Typical electrolytes include salts of monovalent or polyvalent metals of Groups 1, 2, or 3, or organic bases. The alkali metals particularly useful are sodium, potassium, and, or the alkaline earth metals, especially magnesium. Organic bases might include ammonium, trialkylammonium, bis-ammonium salts or the like. The anions of the electrolyte are not critical, except that halides may not be desirable due to metal corrosion. Sulfates, bisulfates, phosphates, nitrates and the like are commonly used. Examples of polyvalent salts include magnesium sulfate and magnesium nitrate.

Polymeric Foam Stabilizers and Thickeners

These components can be optionally incorporated to enhance the foam stability and foam drainage properties. Examples of polymeric stabilizers and thickeners include partially hydrolyzed protein, starches, polyvinyl resins such as polyvinyl alcohol, polyacrylamides, carboxyvinyl polymers, polyvinyl polypyrrolidone, and poly(oxyethylene) glycol.

Low molecular weight PEG can also be used to replace DGME in commercially available synthetic surfactant concentrates.

Exemplary Concentrate Formulations Containing Low Molecular Weight PEG

Exemplary concentrate formulations are shown below. These formulations are not limiting of the range of components that can be used in foam concentrates containing low molecular weight PEG, nor are they limiting of the amounts and relative proportions of the components. When an exemplary formulation specifies a component it will be understood that the specified component can be a mixture of such components. Thus, for example, when the formulations below specify an anionic surfactant, this represents one or more anionic surfactants. Surfactants can be perfluoroalkyl-containing surfactants or non-fluorinated surfactants, if not specifically identified.

Exemplary 3% AFFF Formulation

| Raw Material | Concentration % by wt. |
|---|---|
| Water | 57-96 |
| Salt | 1.0-2.0 |
| Corrosion Inhibitor | 0.02 |
| Poly(ethylene glycol) 200 | 1.0-20.0 |
| Hydrocarbon surfactant 1 | 0.5-4.0 |
| Hydrocarbon 2 | 0.5-4.0 |
| Fluoropolymer | 0.5-6.0 |
| Fluorosurfactant | 0.5-6.0 |

Exemplary 3×3 AR-AFFF Formulation

| Raw Material | Concentration % by wt. |
|---|---|
| Water | 53-96 |
| Salt | 1.0-2.0 |
| Corrosion Inhibitor | 0.04 |
| Biocide | 0.03 |
| Poly(ethylene glycol) 200 | 1.0-15.0 |
| Hydrocarbon Surfactant 1 | 0.5-5.0 |
| Hydrocarbon Surfactant 2 | 0.5-5.0 |
| Hydrocarbon Surfactant 3 | 0.5-5.0 |
| Polysaccharide | 0.3-1.5 |
| Fluorosurfactant | 0.5-7.0 |
| Fluoropolymer | 0.5-5.0 |

Concentrates containing low molecular weight PEG may be produced at any suitable strength including, but not limited to, 1, 3 and 6% (w/w) foam concentrates, which are concentrations that are typical for commercial use. Concentrates that are less than 1% (w/w) or greater than 6% (w/w) also may be prepared. As used herein, the lowest numbered strength for the concentrate used indicates the most concentrated product, i.e., the percent designation refers to the proportioning rate of foam concentrate to water. Accordingly, one part of 1% concentrate used with 99 parts water gives 100 parts of use strength pre-mix; similarly, three parts 3% concentrate and 97 parts water gives 100 parts of pre-mix. As used herein, the term "water" may include pure, deionized or distilled water, tap or fresh water, sea water, brine, or an aqueous or water-containing solution or mixture capable of serving as a water component for the firefighting composition.

The above components would be reduced or increased accordingly relative to the 3% liquid concentrate to prepare 6% and 1% synthetic liquid foam concentrates, or other concentrate levels. Thus, for a 1% concentrate, the above amounts may be increased by a factor of 3, whereas for a 6% concentrate the above amounts may be reduced by half.

Use of Low Molecular Weight PEG-Containing Concentrates

The compositions described herein are useful for preparing foams that can be used for fighting fires in a wide variety of situations, and on a large or small scale, for example forest fires, building fires and the like. The foams are particularly useful for fighting fires caused or fueled by highly flammable industrial liquids, such as petrochemicals, organic solvents, and intermediates or monomers used in polymer synthesis. In particular the foams may be effectively used to suppress and/or extinguish fires where the burning material contains volatile fuels and/or solvents. Examples include, but are not limited to: hydrocarbons and hydrocarbon mixtures such as gasoline, pentane, hexane and the like; alcohols, such as methanol, ethanol, isopropanol and the like; ketones such as acetone, methyl ethyl ketone and the like; ethers, including cyclic ethers, such as diethyl ether, methyl t-butyl ether, ethyl t-butyl ether, tetrahydrofuran and the like; esters, such as ethyl acetate, propyl acetate, ethyl propionate and the like; oxiranes, such as propylene oxide, butylene oxide and the like; and mixtures of one or more of these materials. The skilled artisan will appreciate that this list is merely illustrative and non-limiting.

Methods for fighting fires also are provided, especially for fighting fires of organic liquids or for fighting solids fires. For this purpose, the concentrate will be diluted with water, or added to the extinguishing water in the desired amount, for example in the amounts specified above, and the diluted composition will be foamed by means of suitable equipment to give a foam extinguishant. In general, the equipment is that known for use for production of extinguishing foams. Such equipment generally comprises a means of generating the foam, for example foam nozzles for heavy or medium foam or foam generators, the principle of which is generally based on mixing of the aqueous diluted concentrate with air in a suitable manner to give a foam. In the case of foam nozzles, the aqueous diluted concentrate is fed through a nozzle at high speed into a tube with orifices for ingress of air, which are arranged close to the nozzle, as a result of which air is sucked in and forms a foam. The extinguishing foam thus generated is applied in a manner known per se to the seat of fire or to sites which are to be protected from a fire. The diluted composition is generally obtained in situ, i.e. the concentrate is fed continuously to the extinguishing water during the extinguishment operation, generally by means of so-called inductors, for example inline inductors, injector inductors, pump inductors or bladder tank inductors, which supply the amount of concentrate needed for foam production to the extinguishing water stream or to a portion of the extinguishing water stream.

The foams obtainable from the concentrates are also suitable for covering volatile organic substances, for example organic liquids, e.g. volatile organic chemicals, which have been released into the environment in liquid form in the event of an accident or in some other way. The covering of such substances is possible in a simple manner, by applying a foam over an area, i.e. as a foam blanket, onto the surface of the organic volatile substances, for example an escaped liquid, and in this way covering it. In this way, it is possible to effectively prevent vaporization of the organic substance with the concentrates.

Fire Test Results

Low molecular weight PEG was used to replace DGME in concentrates corresponding to commercially available AFFF and AR-AFFF products. These concentrates were assessed in standard UL 162 tests and provided performance that met the highest level of the test and that was comparable to the original concentrates that contained DGME.

The invention claimed is:

1. An aqueous firefighting foam concentrate comprising:
(a) 0.5 to 7 wt. % of at least one fluorinated surfactant,
(b) 1 to 20 wt. % polyethylene glycol having a weight average molecular weight of about 400 or less,
(c) 0.5 to 6 wt. % fluoropolymer,
(d) non-fluorinated hydrocarbon surfactant, which comprises 1 to 10 wt. % anionic surfactant, 5 to 25 wt. % zwitterionic surfactant, and 5 to 20 wt. % alkyl polyglucoside nonionic surfactant, where the amounts of these surfactants are based on the total weight of the concentrate;
(e) 53 to 96 wt. % water, and
(h) 0.2 to 7 wt. % polysaccharide gum,
wherein the concentrate is free of diethylene glycol monobutyl ether.

2. The concentrate according to claim 1 wherein the polyethylene glycol has a weight average molecular weight of about 200.

3. The concentrate according to claim 1, wherein the concentrate comprises 5 to 8 wt. % octyl sulfate, 10 to 25 wt. % lauryl dipropionate and 6 to 11 wt. % $C_8$-$C_{10}$ alkyl polyglycoside with a 1.6 degree of polymerization.

4. The concentrate according to claim 1, comprising at least two polysaccharide gums.

5. The concentrate according to claim 1, further comprising at least one biocide.

6. The concentrate according to claim 1, further comprising at least one corrosion inhibitor.

7. The concentrate according to claim 1, further comprising an electrolyte.

8. The aqueous firefighting foam concentrate of claim 1, wherein the at least one fluorinated surfactant comprises zwitterionic or anionic $C_6$-perfluoroalkyl surfactant having a molecule weight less than 800 daltons; and the concentrate further comprises a fluoropolymer, which includes a perfluoroalkyl substituted polyamino acid fluoropolymer.

9. The aqueous firefighting foam concentrate of claim 8, wherein the concentrate comprises:
(a) 0.5 to 7 wt. % of the at least one fluorinated surfactant;
(b) 1 to 20 wt. % of the polyethylene glycol;
(c) 0.5 to 6 wt. % of the fluoropolymer;
(e) 5 to 8 wt. % of an anionic surfactant, which comprises octyl sulfate;
(f) 10 to 25 wt. % of a zwitterionic surfactant;

(g) 6 to 11 wt. % of an alkyl polyglucoside nonionic surfactant, which comprises $C_{6/10}$-alkyl polyglucoside; and (h) 0.3 to 1.5 wt. % of the polysaccharide gum, which comprises guar gum and xanthan gum.

10. A firefighting foam prepared by foaming a concentrate according to claim 1 with water.

11. A method of making a firefighting foam comprising foaming a concentrate according to claim 1 with water.

12. A method of extinguishing a fire comprising foaming a concentrate according to claim 1 with water and applying the resulting foam to the fire.

13. A method of extinguishing a burning polar solvent comprising foaming a concentrate according to claim 1 with water and applying the resulting foam to the burning solvent.

14. An aqueous firefighting foam concentrate consisting of:

(a) at least one fluorinated surfactant;

(b) polyethylene glycol having a weight average molecular weight of about 400 or less, (c) at least two non-fluorinated surfactants selected from the group consisting of anionic, zwitterionic and nonionic surfactants, (d) a fluoropolymer, (e) optionally, a corrosion inhibitor, (f) optionally, an electrolyte, (g) 53 to 96 wt. % water, and (h) polysaccharide gum, wherein the concentrate is free of diethylene glycol monobutyl ether; and the concentrate contains 1 to 10 wt. % anionic surfactant; 5 to 25 wt. % zwitterionic surfactant; and 5 to 20 wt. % alkyl polyglucoside nonionic surfactant.

15. The aqueous firefighting foam concentrate of claim 14, wherein the at least two non-fluorinated surfactants comprise (e) anionic surfactant, which comprises alkyl sulfate and/or alkyl ether sulfate;

(f) zwitterionic surfactant, which comprises alkyl betaine and/or alkyl sulfobetaine; and (g) alkyl polyglucoside nonionic surfactant.

16. The aqueous firefighting foam concentrate of claim 15, wherein the anionic surfactant comprises $C_8$-$C_{14}$-alkyl sulfate and/or $C_8$-$C_{14}$-alkyl ether sulfate;

the zwitterionic surfactant comprises $C_6$-$C_{14}$-alkyl betaine and/or $C_6$-$C_{14}$-alkyl sulfobetaine;

the alkyl polyglucoside nonionic surfactant comprises $C_6$-$C_{14}$-alkyl polyglucoside; and the polysaccharide gum comprises guar gum and xanthan gum.

17. A firefighting foam prepared by foaming a concentrate according to claim 14 with water.

18. A method of making a firefighting foam comprising foaming a concentrate according to claim 14 with water.

19. A method of extinguishing a fire comprising foaming a concentrate according to claim 14 with water and applying the resulting foam to the fire.

20. An alcohol-resistant aqueous firefighting foam concentrate comprising:

(a) at least one fluorinated surfactant;

(b) polyethylene glycol having a weight average molecular weight of about 400 or less, (c) at least one non-fluorinated surfactant selected from the group consisting of anionic, zwitterionic and nonionic surfactants, (d) a fluoropolymer, (e) optionally, a corrosion inhibitor, (f) optionally, an electrolyte, (g) a polysaccharide gum, (h) optionally, a biocide, and (i) at least 53 to 96 wt. % water, wherein the concentrate is free of diethylene glycol monobutyl ether; and the concentrate comprises 1 to 10 wt. % anionic surfactant; 5 to 25 wt. % zwitterionic surfactant; and 5 to 20 wt. % alkyl polyglucoside nonionic surfactant.

21. The aqueous firefighting foam concentrate of claim 20, wherein the concentrate comprises 5 to 8 wt. % octyl sulfate, 10 to 25 wt. % lauryl dipropionate and 6 to 11 wt. % $C_8$-$C_{10}$ alkyl polyglycoside with a 1.6 degree of polymerization.

22. The aqueous firefighting foam concentrate of claim 20, wherein the polyethylene glycol has a weight average molecular weight of about 200; the polysaccharide gum comprises guar gum and/or xanthan gum; the at least one fluorinated surfactant comprises zwitterionic and/or anionic $C_6$-perfluoroalkyl surfactant having a molecule weight less than 800 daltons; the fluoropolymer comprises a perfluoroalkyl substituted polyamino acid fluoropolymer; and the concentrate comprises 5 to 8 wt. % octyl sulfate, 10 to 25 wt. % lauryl dipropionate and 6 to 11 wt. % $C_8$-$C_{10}$ alkyl polyglycoside with a 1.6 degree of polymerization.

23. An aqueous firefighting foam concentrate consisting of:

(a) at least one fluorinated surfactant;

(b) polyethylene glycol having a weight average molecular weight of about 400 or less;

(c) at least two non-fluorinated hydrocarbon surfactants selected from the group consisting of anionic, zwitterionic and nonionic hydrocarbon surfactants;

(d) fluoropolymer;

(e) optionally, corrosion inhibitor;

(f) optionally, electrolyte;

(g) optionally, biocide;

(h) 53 to 96 wt. % water; and (i) polysaccharide gum;

wherein the concentrate contains 1 to 10 wt. % anionic surfactant; 5 to 25 wt. % zwitterionic surfactant and 5 to 20 wt. % alkyl polyglucoside nonionic surfactant.

24. The aqueous firefighting foam concentrate of claim 23, consisting of:

(a) 0.5 to 7 wt. % of the at least one fluorinated surfactant;

(b) 1 to 20 wt. % of the polyethylene glycol;

(d) 0.5 to 6 wt. % of the fluoropolymer;

(i) 2 to 7 wt. % of the polysaccharide gum, which comprises galactomannan gum and xanthan gum;

(j) the anionic surfactant, which comprises $C_8$-$C_{20}$-alkyl sulfate and/or $C_8$-$C_{20}$-alkyl ether sulfate;

(k) the zwitterionic surfactant;

(l) the alkyl polyglycoside nonionic surfactant; and optionally, one or more of the corrosion inhibitor, the electrolyte and the biocide.

25. The aqueous firefighting foam concentrate of claim 24, wherein the concentrate comprises 5 to 8 wt. % octyl sulfate, 10 to 25 wt. % lauryl dipropionate and 6 to 11 wt. % $C_8$-$C_{10}$ alkyl polyglycoside with a 1.6 degree of polymerization.

26. A firefighting foam prepared by foaming a concentrate according to claim 23 with water.

* * * * *